United States Patent [19]

Gorodissky et al.

[11] Patent Number: 4,946,433

[45] Date of Patent: Aug. 7, 1990

[54] CENTRIFUGE DRIVE

[76] Inventors: Boris P. Gorodissky, Leninsky prospekt, 154, kv. 201; Alexandr I. Sambursky, ulitsa I.Susanina, 6, korpus 4, kv. 10, both of Moscow, U.S.S.R.

[21] Appl. No.: 380,980

[22] Filed: Jul. 17, 1989

[30] Foreign Application Priority Data

Jul. 18, 1988 [SU] U.S.S.R. ..... 4447751[I]

[51] Int. Cl.[5] ..... B04B 9/00; B04B 9/04; B04B 9/12; B04B 9/14

[52] U.S. Cl. ..... 494/15; 494/61; 494/83; 184/6.18; 184/6.22; 184/31; 310/54; 310/90

[58] Field of Search ..... 494/15, 39, 61, 41, 494/83, 84, 14, 38, 46, 60; 184/6.18, 6.22, 31; 310/54, 90; 384/198

[56] References Cited

U.S. PATENT DOCUMENTS

| | | | |
|---|---|---|---|
| 1,305,796 | 6/1919 | Griscom | 494/15 |
| 3,877,546 | 4/1975 | Shrader | 184/6.18 |
| 4,205,779 | 6/1980 | Jacobson | 494/61 |
| 4,214,179 | 7/1980 | Jacobson et al. | 494/84 |
| 4,226,359 | 10/1980 | Jacobson | 494/84 |
| 4,322,030 | 5/1982 | Jacobsen et al. | 494/15 |
| 4,443,043 | 4/1984 | Yamaguchi | 310/90 |
| 4,846,773 | 7/1989 | Giebeler et al. | 494/83 |

FOREIGN PATENT DOCUMENTS

| | | | |
|---|---|---|---|
| 83/03985 | 11/1983 | PCT Int'l Appl. | 494/83 |

*Primary Examiner*—Timothy F. Simone
*Attorney, Agent, or Firm*—Lilling & Greenspan

[57] ABSTRACT

The drive of a centrifuge utilized in biology, biophysics and medicine includes a casing accommodating a stator and a rotor whose shaft is installed in an angular bearing and rigidly connected with a flexible shaft fixed rotatably in a dumping device. The casing has passages for the circulation of lubricant and coolant, respectively, the rotor has a blind hole arranged coaxially with the rotation axis of the rotor; and the angular bearing has supporting and radial slide surfaces and is fixed in the rotor by means of the damping device so that the radial slide surface is located at least partly in the blind hole of the rotor, said bearing having passages ensuring circulation of lubricant over its supporting and radial surfaces.

4 Claims, 3 Drawing Sheets

CENTRIFUGE DRIVE

BACKGROUND OF THE INVENTION

1. Field of the Invention

The present invention relates to ultracentrifuges used in biology, biophysics, medicine and in other branches of science of engineering and, more particularly, it relates to a centrifuge drive.

2. Description of the Prior Art

One of the essential problems encountered in designing a centrifuge is the development of a stable, simple and reliable, particularly with regard to repairability, design of its drive.

Commonly known in the art is an ultracentrifuge drive comprising a casing with a stator inside and two end brackets whose bearings support the rotor shaft of the electric motor. Connected rigidly with the rotor shaft is a flexible shaft installed rotatably in a damping device. The drive casing is provided with spaces and passages for the circulating coolant. In this drive the bearings of the rotor shaft are installed in different end brackets which adversely affects the coaxially of the construction. Another disadvantage lies in that the bearings are pressed into the end brackets which prevents interchangeability of both the bearings proper and of their end brackets. Besides, the disassembly of the drive is a time- and labour-consuming operation. Still another disadvantage of the known design resides in the presence of thermal resistance existing between the surface of the motor stator and the circulating coolant. Therefore, the stator surface is cooled with a low efficiency. And, finally, the given design has no provision for cooling the damping device.

Another prior art centrifuge drive (U.S. Pat. No. 4322030) comprises a casing accommodating a stator and a rotor whose shaft is mounted in an angular bearing and is rigidly linked with a flexible shaft fixed rotatably in the damping device, the casing being provided with passages for the circulating coolant and lubricant.

The fast drive is located in a vacuum and its rotor can be taken out of the casing complete with the flexible shaft which facilitates repairs.

However, since the bearings are installed in separate elements of the casing, this ensures strict coaxiality in the casing. Besides, replacement of said elements calls either for precision manufacture of said bearing-fastening elements, or an overall replacement of the casing together with said elements. On the other hand, even a slight axial misalignment of bearings raises the vibration level thereby impairing the reliability of the centrifuge drive. Another disadvantage of the prior art centrifuge drive is the absence of cooling of the damping device which impairs its operating conditions especially during prolonged service.

Still another disadvantage of the prior art drive consists in the presence of thermal resistance between the surface of the drive stator and the circulating coolant. Even with the high heat conduction of the material of the casing, the stator will be cooled insufficiently because the entire drive operates in a vacuum. The same reason is responsible for poor cooling of the rotor and damping device.

SUMMARY OF THE INVENTION

In view of the above, the object of the invention is to provide a centrifuge drive wherein stable installation of the bearing relative to the rotor would ensure a high degree of coaxiality, and eliminate undue vibration thus promoting the reliability of operation of the drive.

Another object of the invention is in providing a monolythic construction of the drive.

A still further object is to ensure repairability of the drive and a minimum amount of disassembly operations and to eliminate labor-consuming operations pertaining to the removal of the drive from the centrifuge.

The most important object is to develop a construction permitting simple and reliable removal of the rotor in case of its replacement.

It is also essential to develop a construction of the drive with optimized thermal operating conditions wherein the heat is abstracted directly from the rotor surface and there is a provision for additional cooling of the rotor and damping device.

These and other objects of the invention are attained by providing a centrifuge drive comprising a casing with a rotor and stator accommodated inside, the rotor shaft being mounted in an angular bearing and connected rigidly with a flexible shaft fixed rotatably in a damping device. The casing has passages for circulating lubricant and coolant, respectively. The drive rotor has a blind hole arranged coaxially to the rotor rotation axis and the angular bearing has supporting and radial slide surfaces and is fixed in the rotor by means of the damping device so that the radial slide surface is located at least partly in the blind hole of the rotor, said angular bearing having passages for circulation of lubricant over the supporting and radial surfaces of said bearing.

All this ensures a stable position of the angular bearing relative to the rotor, and a high degree of coaxiality thus eliminating undue vibrations and producing a favorable effect on the reliability of the drive.

Should it become necessary to remove the drive for repairs, this is confined, essentially, to the removal of the damping device. After that the angular bearing and the rotor can be easily taken out of the casing.

An important advantage is that there is no need during this operation for removing the drive from the centrifuge. Another important advantage is the possibility of replacing the motor rotor by performing the above operation. All these factors result in the simplicity and reliability of the design, particularly with respect to its repairability.

It is expedient that the casing of the drive be made in the form of a single element provided with vertical slots arranged near the damping device and communicating with the coolant passages of the casing and the lubricant passages of the casing be connected with the passages of the angular bearing.

This will also improve coaxiality due to the solidity of construction and optimize the thermal conditions.

For this purpose it is expedient that the external surface of the stator be provided with a spiral groove which forms, together with the internal surface of the casing, a space communicating with the casing passages for circulation of coolant.

This ensures direct abstraction of heat from the surface of the stator and additional cooling of the motor rotor due to the additional passages carrying the lubricant dripping down from the radial surface of said bearing. Both these factors optimize the thermal conditions of the drive motor. Besides, this design provides for cooling of the damping device since said vertical slots can be arranged concentrically relative to the damping device which likewise improves the service conditions of the drive and, consequently, enhances its reliability.

BRIEF DESCRIPTION OF THE DRAWINGS

These and other objects of the present invention will be elucidated below in the description of an embodiment of said invention with reference to the appended drawings in which.

DESCRIPTION OF THE PREFERRED EMBODIMENT

Figure 1:
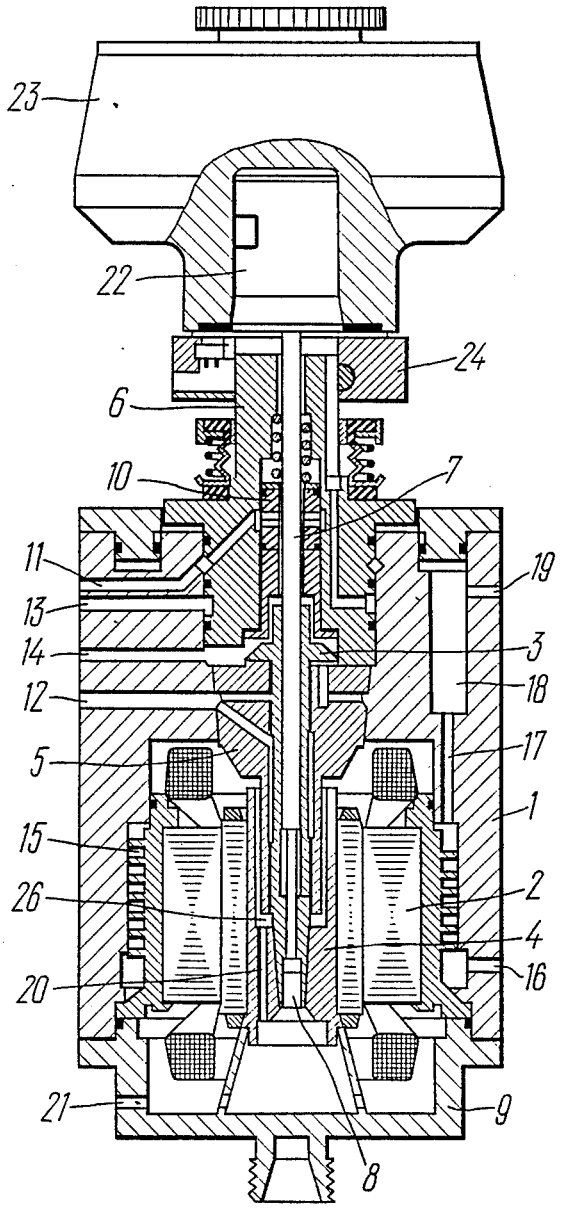
FIG. 1 is a longitudinal sectional view, illustrating the centrifuge drive with a rotor according to the invention.

The centrifuge drive (FIG. 1) comprises a casing 1 in the form of a single element accommodating a stator 2. The shaft 3 of the motor rotor 4 is mounted in an angular bearing 5 which is fixed by a damping device 6. Installed rotatably in the device is a flexible shaft 7. The lower end of the flexible shaft 7 is rigidly connected with the shaft 3 of the rotor 4 which, in turn, is connected rigidly by a screw 8 with the rotor 4. The stator 2 is secured in the casing 1 by means of a cover 9. The damping device 6 (FIG. 2) has a vacuum bearing 10.

Figure 2:
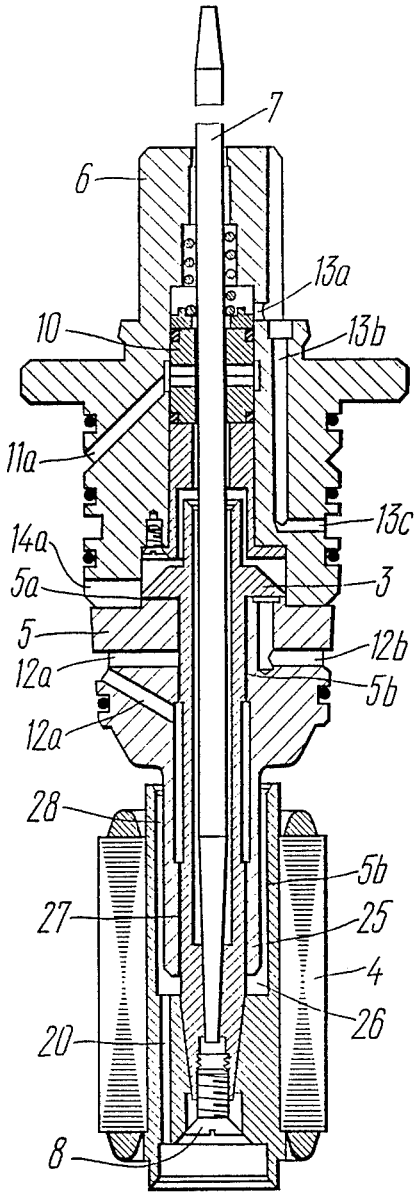
FIG. 2 is a longitudinal sectional view, showing separately the damping device with an angular bearing and the motor rotor according to the invention.

The lubricant for the bearings 5 and 10 (FIG. 1) circulates through passages 11, 12, 13 and 14 of the casing 1, bearings 10 and 5 being supplied with lubricant through passages 11 and 12, respectively, the lubricant being discharged from said bearings 10 and 5 through passages 13 and 14, respectively. The external surface of the stator 2 is provided with a spiral groove which, together with the internal surface of the casing 1, defines a space 15 one side of which communicates with the coolant inlet passage 16 and the other side is connected by passage 17 with the vertical slots 18 made in the casing 1 concentrically with relation to the damping device 6. Passage 19 serves for the discharge of coolant. The inclined passages 20 in the rotor 4 improve its cooling by conducting the lubricant from the angular bearing 5. Then the lubricant is discharged from the passages 20 through a discharge passage 21. This ensures efficient cooling of the stator 2, rotor 4, damping device 6 and the casing 1 as a whole. Secured on the flexible shaft 7 is an adapter 22 for mounting the centrifuge rotor 23. In operation, the speed of the centrifuge rotor 23 is monitored by a sensor 24. Shown additionally in FIG. 2 are passage **11*a* in the damping device 6 through which the lubricant is delivered to the vacuum bearing 10, and passages 12*a* and 12*b* delivering lubricant to the angular bearing 5. The lubricant is discharged from the angular bearing 5 through passage 14*a* and from the vacuum bearing 10, through passages 13*a*, 13*b* and 13*c* of the damping device 6. The angular bearing 5 has a supporting slide surface 5*a* and a radial slide surface 5*b*. The lower end 25 of the angular bearing 5 is fitted into the blind hole 26 of the rotor 4, being installed with the face 27 down. The blind hole 26 is arranged coaxially with the rotation axis of the rotor 4. The angular bearing 5 is fixed in the blind hole 26 of the rotor 4 by means of the damping device 6, the radial slide surface 56 being located at least partly in the blind hole 26 of the rotor 4**.

The radial slide surface **5*b* is provided with a recess 28 which improves the cooling of the angular bearing 5**.

Figure 3:
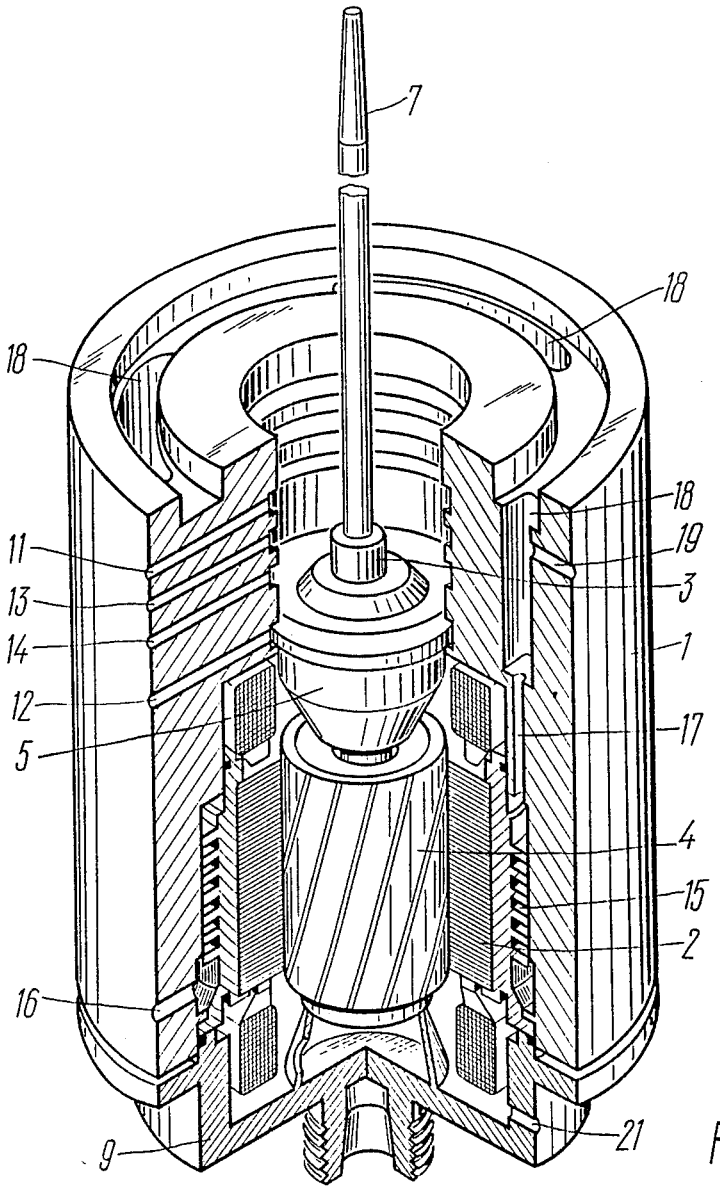
FIG. 3 is a perspective view of the centrifuge drive casing, partly cut out for better understanding of the essence of the invention.

Shown in FIG. 3 is the arrangement of passages 11, 12, 13, 14, 19 in the casing 1 and of the slots 18 of the rotor 4 and angular bearing 5.

The drive functions as follows. Before starting the centrifuge, the centrifuge rotor 23 is installed on the adapter 22 (FIG. 1). As the power supply is turned on, the drive motor begins rotating the flexible shaft 7 and, consequently, the centrifuge rotor 23. The speed of the rotor 23 is continually monitored by the sensor 24.

At the same time the lubricant is fed under pressure into passages 11 and 12 being delivered through passages **12*a* and 11*a* (FIG. 2) to the bearings 5 and 10. Lubrication ensures normal functioning of bearings 5 and 10** and prevents their overheating.

The lubricant is discharged from the angular bearing 5 through passages 14 (FIG. 1) and **14*a* (FIG. 2) while from the vacuum bearing 10 it is taken out through passages 13*a*, 13*b*, 13*c* and 13 (FIG. 1). Dripping down from the radial surface 5*b* (FIG. 2), the lubricant is sucked during rotation of the rotor 4 into inclined passages 20 and, contacting the surface of the rotor 41** ensures direct abstraction of heat, thereby improving its cooling.

In a similar manner, but with the aid of coolant, the heat is abstracted from the surface of the stator 2. In this case the circulating coolant flows through the passage 17 (FIG. 1) to the damping device 6, thus cooling the latter. Pressure built up by the lubricating system (not shown) creates a thin oil film between the supporting surface **5*a* (FIG. 2) of the angular bearing 5 and the corresponding surface of the shaft 3 of the rotor 4 and between the radial slide surface 5*b* and the corresponding surface of said shaft 3. As a result, friction between said surfaces diminishes to a minimum which is quite essential for ensuring high speed of the centrifuge rotor 23** (FIG. 1).

The damping device 6 performs two functions, viz., it fixes rotatably the flexible shaft 7 thus allowing the centrifuge rotor 23 to pass the critical speed point and creates a hermetic seal between the centrifuge drive and its chamber (not shown) accommodating the centrifuge rotor 23. When starting the centrifuge, a preset vacuum is created in its chamber in order to minimize the resistance of air in the course of rotation of the centrifuge rotor 23.

The construction features an optimum rigidity.

Stable position of the angular bearing 5 fixed in the rotor 4 by the damping device 6 and an integral construction of the casing 1 ensure a high degree of coaxiality of these units which eliminates undue vibrations and enhances the reliability of construction.

The accomodation of the angular bearing 5, rotor 4 and damping device 6 and stator 2 in the integral casing optimizes rigidity of the drive and simplifies its assembly and disassembly to a maximum. This provides for the possibility of replacing the angular bearing 5 and rotor 4 thus ensuring the repairability of the drive as a whole.

All this permits minimizing the disassembly work, and eliminating the labor-consuming operations related to the removal of the drive from the centrifuge.

If necessary, the centrifuge rotor 23 in this design of the drive can be removed simply and reliably.

The spiral grooves on the surface of the stator 2 as well as the vertical slots 18 in the monolythic casing 1 arranged concentrically with the damping device 6 ensure direct abstraction of heat from the surface of the stator 2 and additional cooling of the rotor 4 and damping device 6.

We claim:

1. A centrifuge drive, comprising:

a casing having a plurality of passages for circulation of lubricant and coolant, and an internal surface;

a stator fixed in said casing and having an external surface;

a rotor rotatably fixed in said casing and having a shaft and a blind hole arranged coaxially with the rotation axis of said rotor;

an angular bearing supporting said shaft of said rotor, having a supporting slide surface, a radial slide surface, and a plurality of passages, said angular bearing being fixed in said rotor and installed in said blind hole of said rotor so that said radial slide surface is located at least partly in said blind hole of said rotor;

a damping device located in said casing whereby said angular bearing is fixed in said rotor; and a flexible shaft rigidly connected with said shaft of said rotor and fixed rotatably in said damping device;

wherein said plurality of passages of said angular bearing providing circulation of lubricant over said supporting and radial surfaces of said bearing.

2. A centrifuge drive according to claim 1 wherein said casing is made as an integral element and is provided with vertical slots arranged near said damping device and communicating with said plurality of passages of the casing for circulation of coolant and said plurality of passages of the casing for circulation of lubricant are in communication with corresponding passages of said plurality of passages of said angular bearing.

3. A centrifuge drive according to claim 2 wherein said external surface of said stator has a spiral groove which, together with the internal surface of the casing, defines a space communicating with said plurality of passages of the casing for the circulation of coolant.

4. A centrifuge drive according to claim 2 wherein said vertical slots are arranged concentrically with said damping device.

* * * * *